US011655641B2

(12) United States Patent
Liu et al.

(10) Patent No.: US 11,655,641 B2
(45) Date of Patent: May 23, 2023

(54) CONSTRUCTION BUILDING EQUIPMENT AND CONSTRUCTION METHOD THEREOF

(71) Applicants: THE THIRD CONSTRUCTION CO., LTD OF CHINA CONSTRUCTION THIRD ENGNEERING BUREAU, Hubei (CN); CHINA CONSTRUCTION THIRD ENGINEERING BUREAU GROUP CO., LTD, Hubei (CN); CHINA STATE CONSTRUCTION ENGINEERING CORPORATION, Beijing (CN)

(72) Inventors: Xiaoqing Liu, Hubei (CN); Huayong Lu, Hubei (CN); Weixiang Ding, Hubei (CN); Wei Wang, Hubei (CN); Shiqing Qian, Hubei (CN); Jin Li, Hubei (CN); Guowei Xu, Hubei (CN); Buyue Zhang, Hubei (CN); Liai Xu, Hubei (CN); Zhihua Zhang, Hubei (CN); Dong Chen, Hubei (CN); Hanwen Liu, Hubei (CN); Heng Liu, Hubei (CN); Lei Wang, Hubei (CN); Di Li, Hubei (CN); Leilei Zhu, Hubei (CN); Jun Wang, Hubei (CN); Yanhua Zhao, Hubei (CN); Huiwen Deng, Hubei (CN); Haonan Wang, Hubei (CN); Shilong Wen, Hubei (CN); Xisheng Tian, Hubei (CN)

( * ) Notice: Subject to any disclaimer, the term of this patent is extended or adjusted under 35 U.S.C. 154(b) by 318 days.

(21) Appl. No.: 17/035,702

(22) Filed: Sep. 29, 2020

(65) Prior Publication Data

US 2021/0198908 A1 Jul. 1, 2021

(30) Foreign Application Priority Data

Dec. 29, 2019 (CN) ..... 201911386323.8
Dec. 29, 2019 (CN) ..... 201922415418.X

(51) Int. Cl.
*E04G 11/28* (2006.01)
*E04G 3/28* (2006.01)

(52) U.S. Cl.
CPC ..... *E04G 11/28* (2013.01); *E04G 3/28* (2013.01); *E04G 2003/286* (2013.01)

(58) Field of Classification Search
CPC ..... E04G 11/28; E04G 3/28; E04G 2003/286
See application file for complete search history.

(56) References Cited

U.S. PATENT DOCUMENTS 5,630,482 A * 5/1997 Schworer ..... E04G 11/28 425/65
6,557,817 B2 * 5/2003 Waldschmitt ..... E04G 11/28 249/19

(Continued)

*Primary Examiner* — Brian D Mattei
*Assistant Examiner* — Kathleen M. McFarland
(74) *Attorney, Agent, or Firm* — JCIP Global Inc.

(57) ABSTRACT

A construction building equipment includes hanging pedestals, sleeve frames, hydraulic cylinders, upper reversing boxes, lower reversing boxes and track columns. The multiple hanging pedestals are fixed on an outer side of a shear wall of an external wall. The sleeve frames and the track columns are clamped on the hanging pedestals. The sleeve frames are clamped on outer sides of the track columns. The lower reversing boxes are fixed at upper ends of the sleeve frames. The hydraulic cylinders are connected with the upper reversing boxes and the lower reversing boxes. Side surfaces of the track columns are provided with pane holes for cooperative climbing of the upper reversing boxes and the lower reversing boxes. Upper ends of the track columns are fixedly connected with a top platform. Hangers and formworks are suspended on the top platform through booms.

5 Claims, 17 Drawing Sheets

(56) References Cited

U.S. PATENT DOCUMENTS 7,513,480 B2 * 4/2009 Bergaretxe ..... E04G 11/28 249/20
8,317,244 B1 * 11/2012 Schuyleman ..... B66C 1/105 294/67.5
8,413,949 B2 * 4/2013 Schwoerer ..... E04G 11/28 249/20
8,464,996 B2 * 6/2013 Spindler ..... E04G 11/28 249/20
8,673,189 B2 * 3/2014 Schwoerer ..... E04G 11/28 249/20
8,701,827 B2 * 4/2014 Taylor ..... E04G 21/3223 52/122.1
8,714,512 B2 * 5/2014 Schwoerer ..... E04G 11/20 249/20
9,181,719 B2 * 11/2015 Jentsch ..... B28B 1/14
9,303,418 B2 * 4/2016 Schwoerer ..... E04G 11/28
9,476,210 B2 * 10/2016 Urzelai Ezkibel ..... E04G 3/28
9,945,135 B2 * 4/2018 Aranburu Etxezarreta ..... E04G 5/04
10,077,564 B1 * 9/2018 Gruebler ..... E04G 19/003
10,358,833 B2 * 7/2019 Dingier ..... E04G 3/28
10,428,536 B2 * 10/2019 Gardner ..... E04G 3/20
10,465,398 B2 * 11/2019 Herzog ..... E04G 3/28
10,590,664 B2 * 3/2020 Aranburu Etxezarreta ..... E04G 3/28
10,711,470 B2 * 7/2020 Vogl ..... E04G 11/32
10,865,575 B2 * 12/2020 Schmid ..... F16M 13/022
10,914,083 B2 * 2/2021 Johnson ..... E04G 11/02
11,098,490 B2 * 8/2021 Baum ..... E04G 11/28
11,174,650 B2 * 11/2021 Schlett ..... E04G 11/28
11,248,382 B1 * 2/2022 Magnusen ..... E04G 11/28
11,359,390 B2 * 6/2022 Deifel ..... E04G 11/28
11,408,188 B1 * 8/2022 Magnusen ..... E04G 17/18
2003/0052249 A1 * 3/2003 Waldschmitt ..... E04G 11/28 249/20
2007/0119116 A1 * 5/2007 Arozena Bergaretxe ..... E04G 11/28 52/633
2008/0257644 A1 * 10/2008 Schwoerer ..... E04G 3/20 182/142
2009/0146041 A1 * 6/2009 Schwoerer ..... E04G 11/20 249/20
2009/0173574 A1 * 7/2009 Hobmeier ..... E04G 11/28 182/82
2009/0189053 A1 * 7/2009 Spindler ..... E04G 11/28 249/19
2010/0038518 A1 * 2/2010 Schwoerer ..... E04G 11/28 249/20
2010/0212237 A1 * 8/2010 Schwoerer ..... E04G 11/28 52/122.1
2013/0020732 A1 * 1/2013 Jentsch ..... E04G 21/02 249/20
2015/0101887 A1 * 4/2015 Schwoerer ..... E04G 11/28 182/142
2015/0129359 A1 * 5/2015 Urzelai Ezkibel ..... E04G 5/04 182/82
2015/0184402 A1 * 7/2015 Gardner ..... G06F 1/3265 182/131
2016/0040441 A1 * 2/2016 Dingier ..... E04G 21/3223 248/241
2017/0349419 A1 * 12/2017 Lee ..... B66F 11/04
2018/0023308 A1 * 1/2018 Aranburu Etxezarreta ..... E04G 21/3247 52/126.1
2018/0106053 A1 * 4/2018 Schmid ..... F16M 13/022
2018/0179770 A1 * 6/2018 Herzog ..... E04G 5/04
2018/0238063 A1 * 8/2018 Cheng ..... E04G 3/28
2018/0245357 A1 * 8/2018 Gruebler ..... E04G 11/28
2018/0334815 A1 * 11/2018 Baum ..... E04G 11/28
2019/0071884 A1 * 3/2019 Aranburu Etxezarreta ..... E04G 3/28
2019/0145111 A1 * 5/2019 Vogl ..... E04G 11/32 249/20
2019/0376301 A1 * 12/2019 Johnson ..... E04G 21/0445
2020/0002958 A1 * 1/2020 Chen ..... E04G 21/3247
2020/0048918 A1 * 2/2020 Schlett ..... E04G 11/28
2020/0149301 A1 * 5/2020 Lee ..... E04G 11/28
2020/0190832 A1 * 6/2020 Abadia Perez ..... B66C 23/32
2020/0299977 A1 * 9/2020 Amon ..... E04G 11/28
2020/0332539 A1 * 10/2020 Deifel ..... E04G 11/28
2021/0002909 A1 * 1/2021 Kolb ..... E04G 21/3261
2021/0032886 A1 * 2/2021 Schmid ..... E04G 3/28
2021/0156156 A1 * 5/2021 Mork ..... E04G 17/002
2021/0198908 A1 * 7/2021 Liu ..... E04G 3/28
2021/0293037 A1 * 9/2021 Schmid ..... E04G 11/24
2021/0316970 A1 * 10/2021 Hardin ..... E04G 21/142
2022/0032500 A1 * 2/2022 Bramberger ..... B66C 13/48

* cited by examiner

CONSTRUCTION BUILDING EQUIPMENT AND CONSTRUCTION METHOD THEREOF

CROSS-REFERENCE TO RELATED APPLICATION

This application claims the priority benefit of China application serial no. 201922415418.X and 201911386323.8, filed on Dec. 29, 2019. The entirety of each of the above-mentioned patent applications is hereby incorporated by reference herein and made a part of this specification.

BACKGROUND

Technical Field

The present invention relates to the field of construction, in particular to light-weight, circulating and high-efficiency construction building equipment and a construction method thereof.

Description of Related Art

At present, traditional construction methods of high-rise residential buildings mainly adopt a combination of an attached lifting scaffold and an aluminum mold construction technology. The attached lifting scaffold is a climbing frame, and an external facade of the attached lifting scaffold covers four and a half floors. The climbing frame device has various forms and is gradually upgraded from an early steel base frame-steel pipe scaffold device to an all-steel scaffold device, and the appearance and safety of a frame body are strengthened. Climbing frame manufacturers adopt standardized components for production, machining and assembly. After more than 10 years of engineering site inspection, the technology has been quite mature, while the disadvantage is that the climbing frame cannot carry a formwork to climb up. The fulcrum of a building external climbing frame is usually selected at a shear wall of an external wall, and an electric hoist is a main power device of the external climbing frame.

Traditional self-climbing devices carrying formworks are climbing formwork devices currently, are widely used in super high-rise public buildings and infrastructure bridge towers, and mainly adopt external wall external fulcrums. The structure of a climbing formwork is simple, a small oil cylinder with a lifting force being less than 20 t within a stroke of 20 cm is used as a power device, the self-climbing devices can carry the formworks and outer frames to climb up together, while the disadvantage is that an external facade frame body only covers two and a half floors.

SUMMARY

The technical problem to be solved by the present invention is to provide light-weight, circulating and high-efficiency construction building equipment and a construction method thereof.

The technical solution adopted by the present invention to solve the technical problem is as follows. A construction building equipment includes hanging pedestals, sleeve frames, hydraulic cylinders, upper reversing boxes, lower reversing boxes and track columns. The multiple hanging pedestals are fixed on an outer side of a shear wall of an external wall; the sleeve frames and the track columns are clamped on the hanging pedestals. The sleeve frames are clamped on outer sides of the track columns. The lower reversing boxes are fixed at upper ends of the sleeve frames. The hydraulic cylinders are connected with the upper reversing boxes and the lower reversing boxes. Side surfaces of the track columns are provided with pane holes for cooperative climbing of the upper reversing boxes and the lower reversing boxes. Upper ends of the track columns are fixedly connected with a top platform. Hangers and formworks are suspended on the top platform through booms.

In the above solution, the hanging pedestals are provided with rotatable central hooks, the track columns are provided with multiple stoppers which are matched with the central hooks, and the central hooks are clamped under the stoppers to prevent the track columns from falling. When the track columns are lifted, the stoppers located above the central hooks are separated from the central hooks, when the stoppers located under the central hooks move upwards to be in contact with the central hooks, the central hooks rotate under an acting force of the stoppers, and when the stoppers move upwards to the positions above the central hooks, the central hooks return to initial positions, and the central hooks block the stoppers thereabove.

In the above solution, the hanging pedestals are provided with connecting bases, the top portions and the bottom portions of the sleeve frames are provided with lug plates used for cooperative fixing with the connecting bases, the lug plates are provided with short shafts, the short shafts are clamped in bayonets of the connecting bases, the lug plates are rotatably disposed on the sleeve frames through rotating shafts, and the lug plates are further connected with the sleeve frames through tension springs.

In the above solution, guide bases are further disposed below the connecting bases, first guide wheels and second guide wheels are disposed on the guide bases, the first guide wheels are in contact with the sleeve frames, and the second guide wheels are in contact with the track columns.

In the above solution, the formworks are connected with lifting rings, the lifting rings are connected with the booms, and adjustable turnbuckles are disposed in middle portions of the booms.

In the above solution, walkway plates and flaps are disposed on the hangers.

In the above solution, an awning device is disposed on the top platform, the awning device includes slides, supporting keels and awning cloth, and the awning cloth is movable along the slides to be opened and closed.

In the above solution, hoisting equipment is disposed on the top platform.

In the above solution, a material distributor is disposed on the top platform.

The present invention also provides a construction method of the above-mentioned integrated platform, and the method specifically includes the following steps. Separating formworks from a wall body before the integrated platform is lifted, then carrying the formworks through hydraulic cylinders to go up for one floor, afterwards, binding vertical rebars of the upper floor, assembling the vertical formworks after the vertical rebars of the upper floor are bound, erecting the horizontal formworks, and finally pouring concrete, thereby completing construction of one floor.

By implementing the light-weight, circulating and high-efficiency construction building equipment and the construction method thereof of the present invention, the following beneficial effects are achieved.

1. Gable parts of the external wall are adopted as attachment fulcrums in the present invention, supporting columns do not penetrate horizontal floor slabs, and horizontal and vertical structures are constructed synchronously to a ceiling.

2. In the present invention, a truss platform provided in the top portion is connected vertically and horizontally, a valuable aerial work platform is provided while the overall safety of a structure is improved, and a platform for the integration of the equipment is further provided.

3. A hanger system and a formwork system are integrated through the booms in a suspended mode, and the manual installation and disassembly operations on site are greatly reduced.

4. The openable awning device disposed at a top portion of an operating floor converts outdoor operations on site into indoor operations, the on-site operation environment is improved, conditions for 24-hour continuous operation on site are created, on-site construction is prevented from being affected by rain and high temperature, and the overall construction period of the structure is shortened. The on-site operation efficiency is improved by integrating the material distributor, the small hoisting equipment and other parts to the top of the platform.

5. The building machine construction method described in the present invention is matched with the floor rebar→formwork→concrete process, serves decoration construction while meeting the structure construction requirement for 4 days/floor, and provides convenience for the structural layer operation without causing interference to structure construction.

6. The sleeve frames and the track columns of the present invention are slidably connected, adopt a "two-in-one" design mode, and are lifted in position in one step, and thus the lifting operation procedures are simplified.

7. The top platform of the present invention can adopt light-weight 321 Bailey sheets, the overall device safety is improved, a rare equipment integration site is provided for aerial work, by arranging the hydraulic remote control material distributor, the small hoisting equipment and other parts, on-site construction is effectively served, and the on-site operation efficiency is improved.

8. An external hanger system of the present invention can suspend five and a half operating floors, and provides an operation platform for the next step of decoration construction and door and window installation while meeting the upper structure operation requirement, advance penetration and insertion of the external facade procedure are facilitated, and the overall engineering construction period is shortened.

9. External wall body and elevator shaft formworks are set as the formworks for integral suspension, and are lifted upwards along with the building machine device as a whole, on-site disassembly and assembly operations are avoided, and the appearance quality of wall body concrete is improved while labor is saved.

BRIEF DESCRIPTION OF THE DRAWINGS

The present invention is further described below in conjunction with the accompanying drawings and embodiments.

DESCRIPTION OF THE EMBODIMENTS

In order to understand the technical characteristics, purposes and effects of the present invention more clearly, the specific embodiments of the present invention will now be described in detail with reference to the accompanying drawings.

Figure 1:
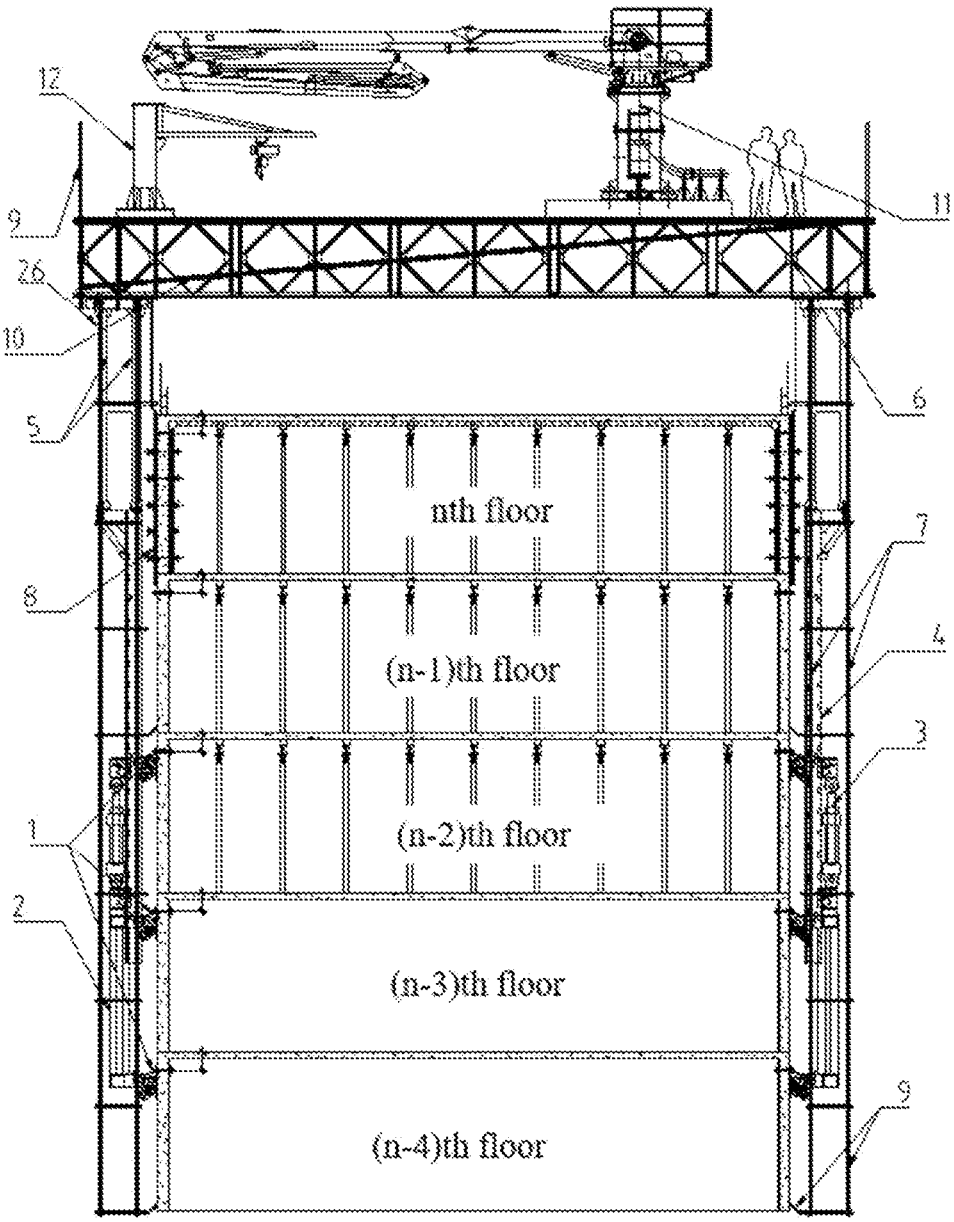
FIG. 1 is a structural schematic diagram of a construction building equipment of the present invention.
Figure 2:
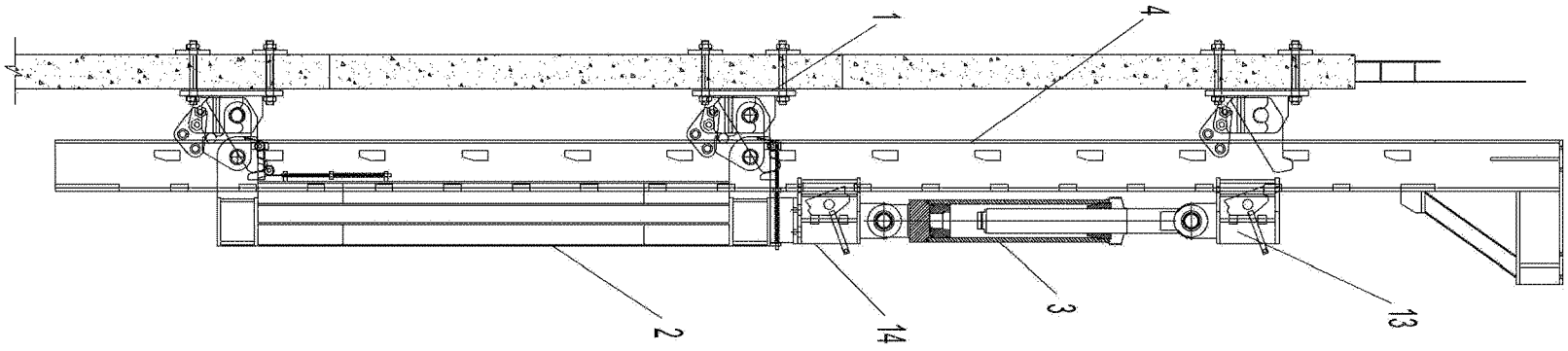
FIG. 2 is a structural schematic diagram of coordination of a hanging pedestal, a sleeve frame and a track column.
Figure 3:
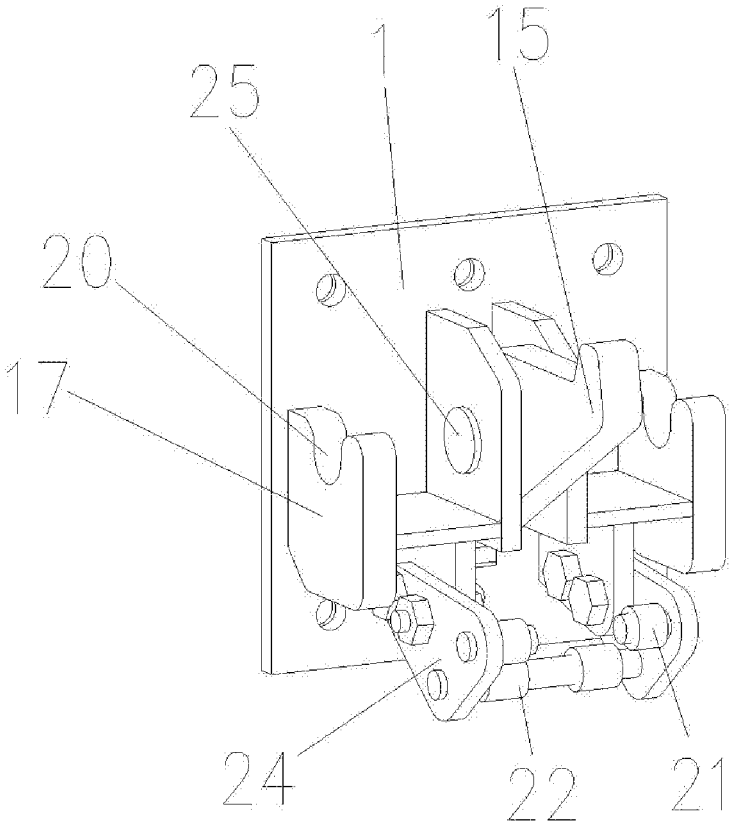
FIG. 3 is a structural schematic diagram of a hanging pedestal.
Figure 4:
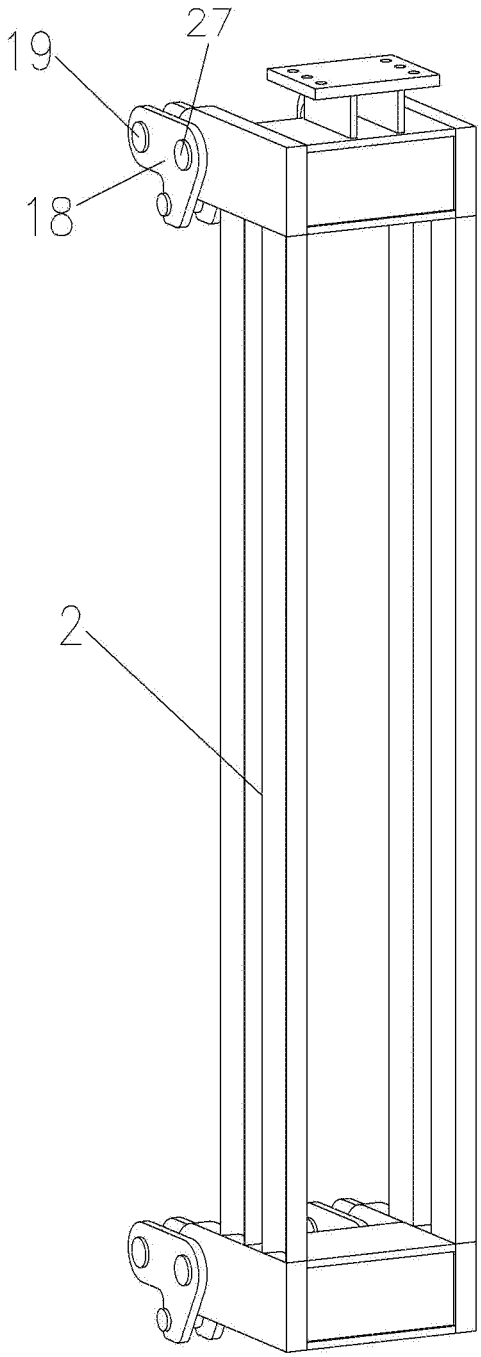
FIG. 4 is a structural schematic diagram of a sleeve frame.
Figure 5:
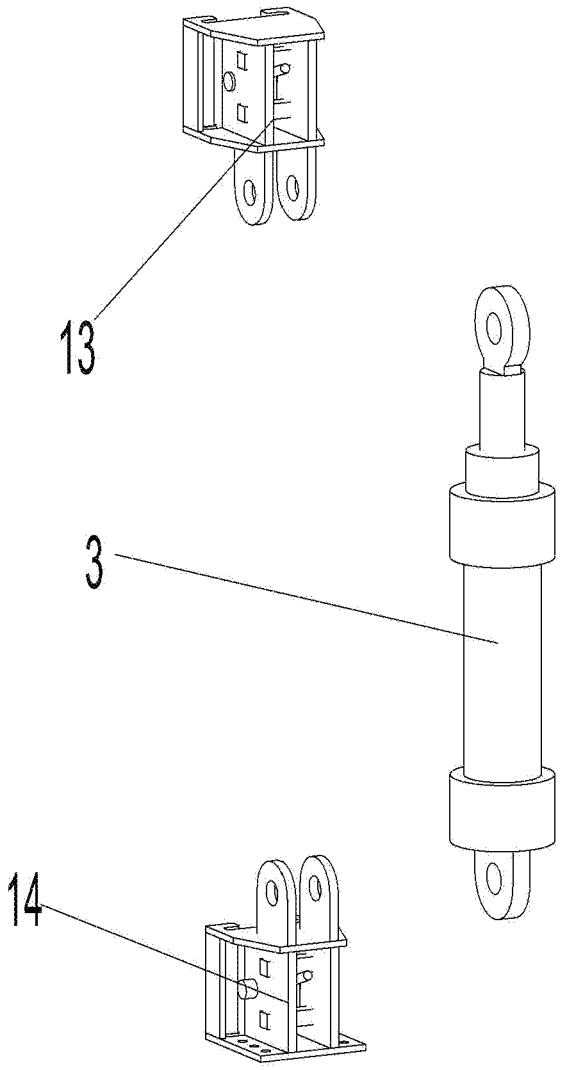
FIG. 5 is a structural schematic diagram of a hydraulic cylinder, an upper reversing box and a lower reversing box.
Figure 6:
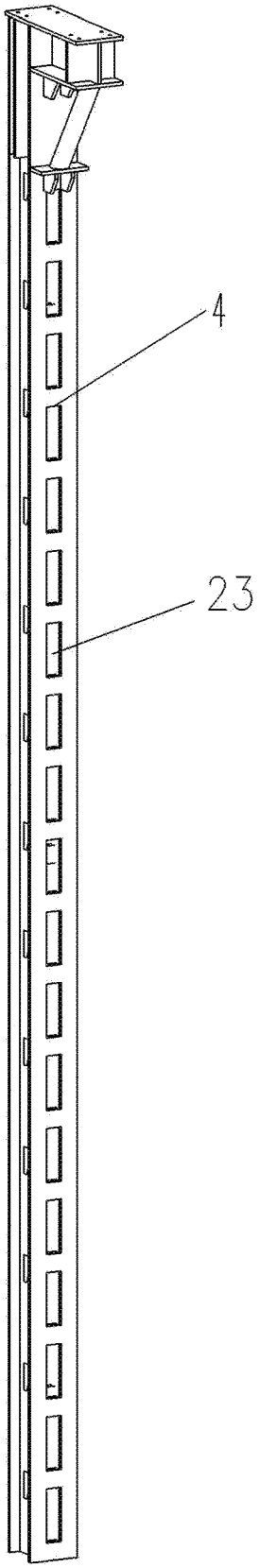
FIG. 6 is a structural schematic diagram of a track column.
Figure 7:
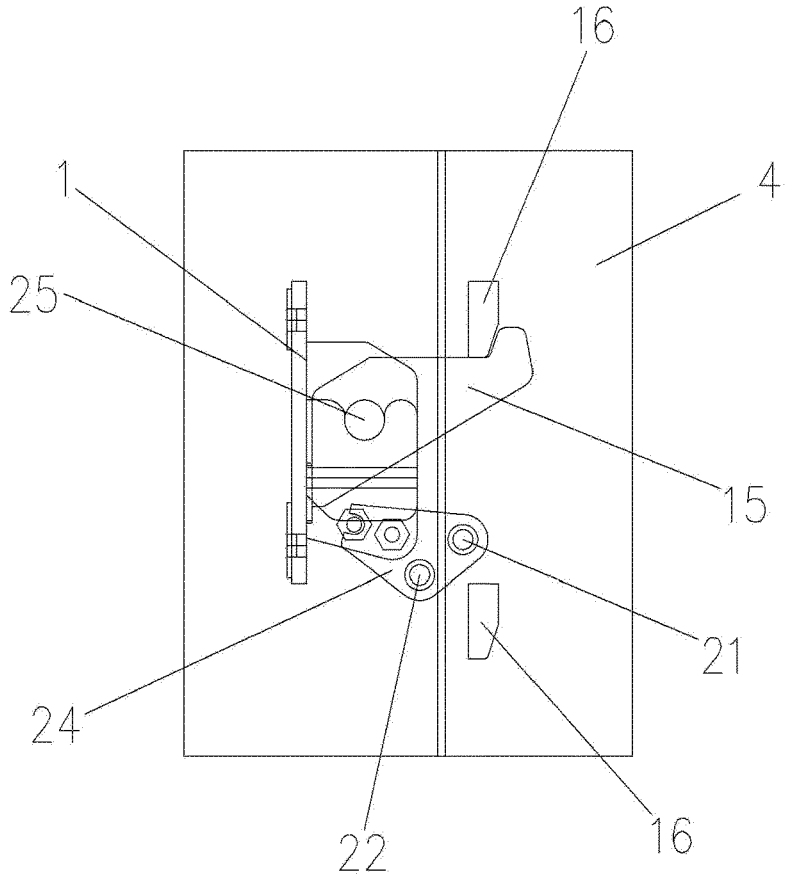
FIG. 7 is an enlarged view of a connection between a hanging pedestal and a track column.
Figure 8:
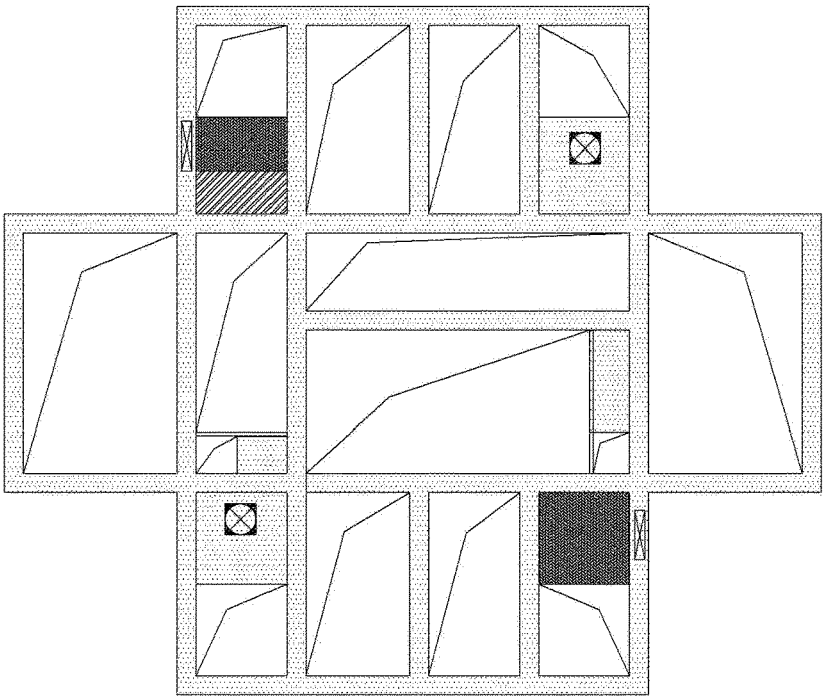
FIG. 8 is a top view of a top platform.

As shown in FIG. 1 to FIG. 8, a construction building equipment of the present invention includes hanging pedestals 1, sleeve frames 2, hydraulic cylinders 3, upper reversing boxes 13, lower reversing boxes 14 and track columns 4. The multiple hanging pedestals 1 are fixed on an outer side of a shear wall of an external wall. The sleeve frames 2 in the embodiment are in a C shape. The sleeve frames 2 and the track columns 4 are clamped on the hanging pedestals 1, the sleeve frames 2 are clamped on outer sides of the track columns 4, and the sleeve frames 2 and the track columns 4 are in sliding fit. The lower reversing boxes 14 are fixed at upper ends of the sleeve frames 2, the hydraulic cylinders 3 are connected with the upper reversing boxes 13 and the lower reversing boxes 14, and the upper reversing boxes 13 are slidably connected with the track columns 4. Upper ends of the track columns 4 are fixedly connected with a top platform 6, and hangers 7 and formworks 8 are suspended on the top platform 6 through booms 26.

Multiple spaced pane holes 23 are formed in side edges of the track columns 4, and the pane holes 23 are climbing force bearing holes of the upper reversing boxes 13 and the lower reversing boxes 14. When the track columns 4 are in use, the upper reversing boxes 13 and the lower reversing boxes 14 connect the sleeve frames 2 with the track columns 4 through the pane holes 23. The upper reversing boxes 13 and the lower reversing boxes 14 are suspended at bottom portions of the pane holes 23 or abut against top portions of the pane holes 23, and the upper reversing boxes 13 and the lower reversing boxes 14 reciprocate to achieve lifting of the track columns 4 or lifting of the sleeve frames 2.

The hanging pedestals 1 in the embodiment are steel hanging pedestals. The hanging pedestals 1 are disposed on the outer side of the shear wall of the external wall and fixed to a wall body through M42 high-strength bolts or similar bolts. The hanging pedestals 1 are provided with central hooks 15 and pin shafts 25 and used for bearing a load transferred from a whole building machine device. The hanging pedestals 1 are connected with the track columns 4 and the sleeve frames 2, and laterally limit a movement direction of the track columns 4.

The hydraulic cylinders 3 are disposed between the track columns 4 and the sleeve frames 2, and connect the track columns 4 and the sleeve frames 2 into a complete supporting power device through the upper reversing boxes 13 and the lower reversing boxes 14. The hydraulic cylinders 3 are source power devices for a building machine to achieve self-climbing.

The track columns 4 can penetrate through the sleeve frames 2. When a frame body is lifted, the sleeve frames 2 and the hanging pedestals 1 are fixed, and the track columns 4 are lifted upwards through the reciprocating movement of the hydraulic cylinders 3 with a short stroke. After the track columns 4 are lifted in position, the track columns 4 are fixed to the hanging pedestals 1, and the sleeve frames 2 self-climb in position along the track columns 4.

The hanging pedestals 1 are provided with the rotatable central hooks 15, and the track columns 4 are provided with multiple stoppers 16 which are matched with the central hooks 15. The central hooks 15 are hinged on the hanging pedestals 1 through the pin shafts 25, return springs may be disposed on the pin shafts 25, and the central hooks 15 can only rotate in a small range. The central hooks 15 are clamped under the stoppers 16 to prevent the track columns 4 from falling. When the track columns 4 are lifted, the stoppers 16 located above the central hooks 15 are separated from the central hooks 15, when the stoppers 16 located under the central hooks 15 move upwards to be in contact with the central hooks 15, the central hooks 15 rotate counterclockwise under the acting force of the stoppers 16, and when the stoppers 16 move to the positions above the central hooks 15, the central hooks 15 automatically return to initial positions, and the central hooks 15 block the stoppers 16 thereabove to achieve the purpose of fall prevention.

The hanging pedestals 1 are further provided with connecting bases 17. The top portions and the bottom portions of the sleeve frames 2 are provided with lug plates 18 used for cooperative fixing with the connecting bases 17. The lug plates 18 are provided with short shafts 19, and the short shafts 19 can be clamped (engaged) in grooves 20 of the connecting bases 17 to achieve the purpose of fall prevention. The lug plates 18 are rotatably disposed on the sleeve frames 2 through rotating shafts 27, and the lug plates 18 are further connected with the sleeve frames 2 through tension springs. When the sleeve frames 2 rise, the lug plates 18 are in contact with the above hanging pedestals 1, the short shafts 19 of the lug plates 18 rotate upwards and rotate clockwise in the view of FIG. 2, after the lug plates 18 pass over the hanging pedestals 1, the lug plates 18 rotate and return to an original position under the action of the tension springs, the lug plates 18 rotate and return to the original position, and the short shafts 19 fall into the grooves 20.

Guide bases 24 are further disposed below the connecting bases 17. First guide wheels 21 and second guide wheels 22 are disposed on the guide bases 24. The first guide wheels 21 are in contact with the sleeve frames 2, and the second guide wheels 22 are in contact with the track columns 4. The first guide wheels 21 and the second guide wheels 22 ensure that the track columns 4 and the sleeve frames 2 are not deviated when being lifted upwards, and ensure that lifting positions are accurate.

Top portions of the track columns 4 are connected with heightening stand columns 5, and the heightening stand columns 5 are connected with the track columns 4 through flanges or similar steel structures. In the embodiment, the top platform 6 is a Bailey sheet steel platform, and the heightening stand columns 5 are connected with the top Bailey sheet steel platform through bolt welding or similar steel structures. The heightening stand columns 5 are common steel structural members, have lower cost than that of machined parts of the track columns 4 and can transmit a vertical load of the top platform 6 well with consideration of pedestrian passages of the external hangers 7.

The Bailey sheet steel platform is formed by horizontally and vertically splicing 321 standard Bailey sheets with a height of 1.5 m and a length of 3 m and non-standard Bailey sheets with other lengths. The layout of the Bailey sheets is designed based on a planar structure of a building and adopted after overall modeling and checking calculations are carried out through Midas calculation software. Plates are laid on a top surface of the top platform 6 for pedestrian passing and stacking some materials, a material distributor 11 and hoisting equipment 12 may be disposed on the top surface, and a material discharge hole is reserved for construction of an operating floor. A hanger system and a formwork system are suspended on a bottom surface of the top platform 6 through booms 26 for assisting in construction of the operating floor.

The hanger system includes components such as the booms 26, small cross bars, riffled plate walkway plates, heavy steel mesh walkway plates and riffled plate flaps. The components are welded and assembled by bolts, pin shafts and flat irons. Walkways are 8-step long or so, and the single-step floor height is 2 m or higher. The top walkway of the hangers 7 achieves the effects as a construction platform for the formwork 8 at the external wall, the middle walkway of the hangers 7 achieves the effects as a cleaning and maintenance platform for an external facade after removal of the formwork, and the bottom walkway of the hangers 7 achieves the effects as a decoration work platform for external wall door and window installation, plastering and putty construction.

The formwork system includes the booms 26, lifting rings and large formworks. Small formworks at the external wall are connected to form the formworks 8 by strengthening and fastening. The formworks 8 are disposed and removed as a whole when in use. The U-shaped lifting rings are generally disposed at appropriate positions of top portions of the formworks 8 at an interval of about 1 m. The lifting rings and the Bailey sheet steel platform are connected through the booms 26. The booms 26 generally adopt round steel of about Φ20, adjustable turnbuckles are disposed in the middle portions of the booms 26, and thus elevation positions of the formworks 8 can be adjusted. After removal of tension screws of the formworks 8, the formworks 8 are moved backwards and separated from a structural wall body in a whole, and are moved forwards for assembly after the building machine is self-lifted for a structural floor, and therefore the integrated design of the formwork system and the building machine is achieved.

External facades of the hangers 7 are provided with facade and horizontal protection devices 9. The facade and horizontal protection devices 9 include protection screens, protection screens around the top surface of the top platform 6, protection steel plates in gaps between the hangers 7 and a structure, and the like, and are used for meeting necessary protective measures for on-site safe operations, and the integrated design with the building machine better highlights the safety characteristic of the building machine.

An awning device 10 is disposed at all openings inside the Bailey sheet steel platform, and disposed within the height range of 1.5 m of the Bailey sheets. The awning device 10 includes slides, supporting keels and awning cloth, can be opened and closed as required and changes outdoor operations into indoor operations to meet the needs of on-site all-weather operations. In case of moderate rain or light rain or high temperature on site, the awning device 10 is adopted to close all the openings, and construction operations on the operating floor are normally conducted. When the weather on site is normal, the awning device 10 is opened for lifting and transportation of rebars and other materials.

The top platform 6 is provided with the material distributor 11. The material distributor 11 in the embodiment is a remote control material distributor 11, includes a fixed base, a hydraulic rotary plate and an adjustable material distributing arm, and is usually supplied by a professional manufacturer in a complete set. The base of the material distributor 11 is fixed on the top surface or the bottom surface of the top platform 6, a pump pipe only needs to be connected to a bottom portion of the material distributor 11 to achieve concrete pouring and distributing in a wide range, and the convenience and operation efficiency of concrete pouring are improved.

The top platform 6 is further provided with the hoisting equipment 12, and the hoisting equipment 12 includes a base, a rotating arm and an electric hook and is usually transformed from a finished hoisting tool provided by a professional manufacturer. The hoisting equipment 12 is disposed on the top surface or the bottom surface of the top platform 6, can carry out hoisting and transportation operations in a certain range, and can facilitate operation hoisting and material transportation of the operating floor with low lifting weight, and thus the level of on-site assembly operations is improved.

Compared with traditional external climbing frame devices, the hangers 7 of the present invention can cover more floors. In this case, the hangers 7 cover five and a half floors, which can actually be more. A large formwork system is integrated to and suspended at the bottom surface of the top platform 6, construction equipment and the awning device 10 are integrated to the top surface of the top platform 6, and the top platform 6 draws the external frame body, so that the overall safety of the device is enhanced, and the device has obvious advantages over traditional external climbing frames.

Before lifting the device, the overhanging formworks 8 are separated from the wall body, then the formworks 8 are carried through power of the hydraulic cylinders 3 to go up for one floor height. Afterwards, vertical rebars of the upper floor are bound, the formworks 8 being vertical are assembled after the vertical rebars of the upper floor are bound, and the formworks 8 being horizontal are erected. Finally, the concrete is poured through the material distributor 11, thus, a standard construction process is completed, and the standard floor construction period is 4 days.

Figure 9A:
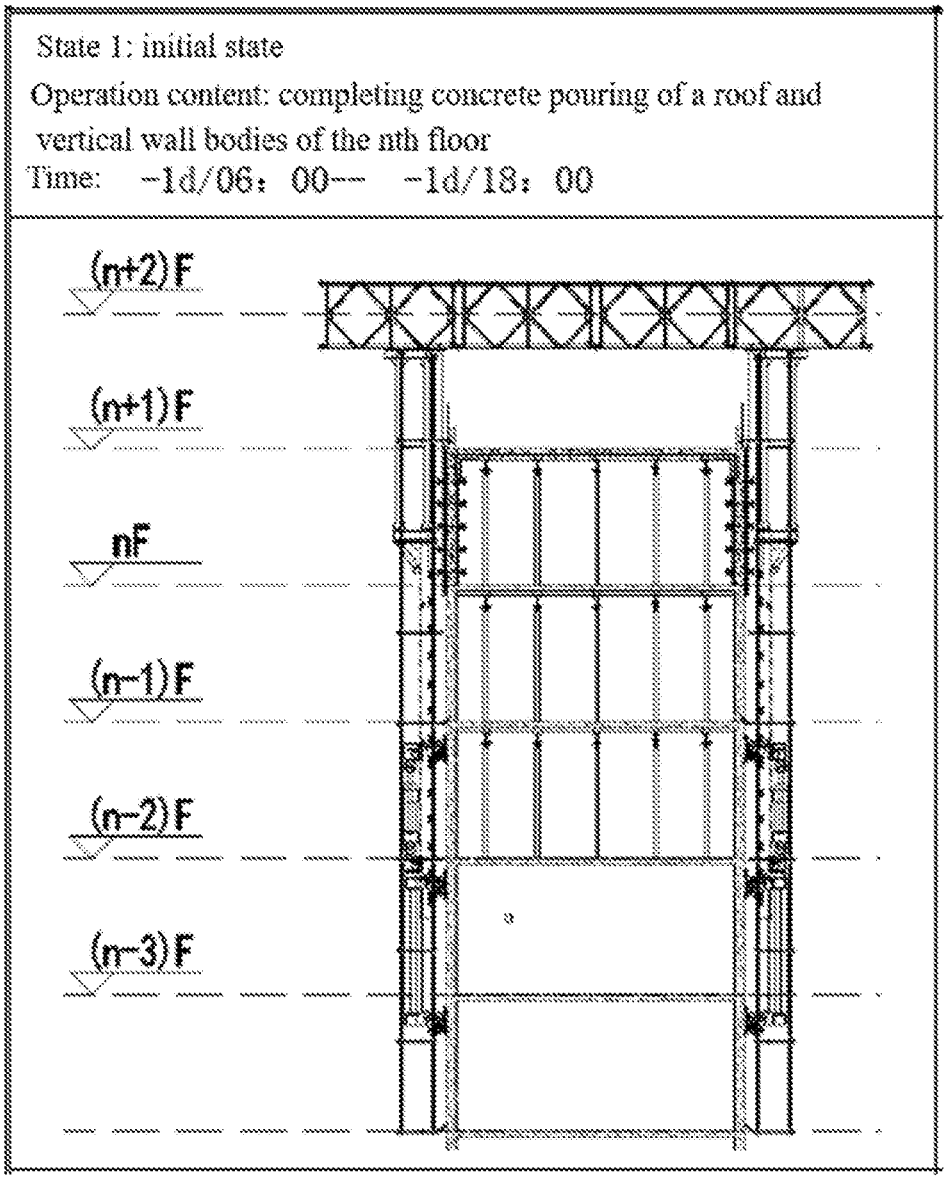
FIG. 9*a* to FIG. 9*j* are flow exploded views of a construction method of the present invention.
Figure 9B:
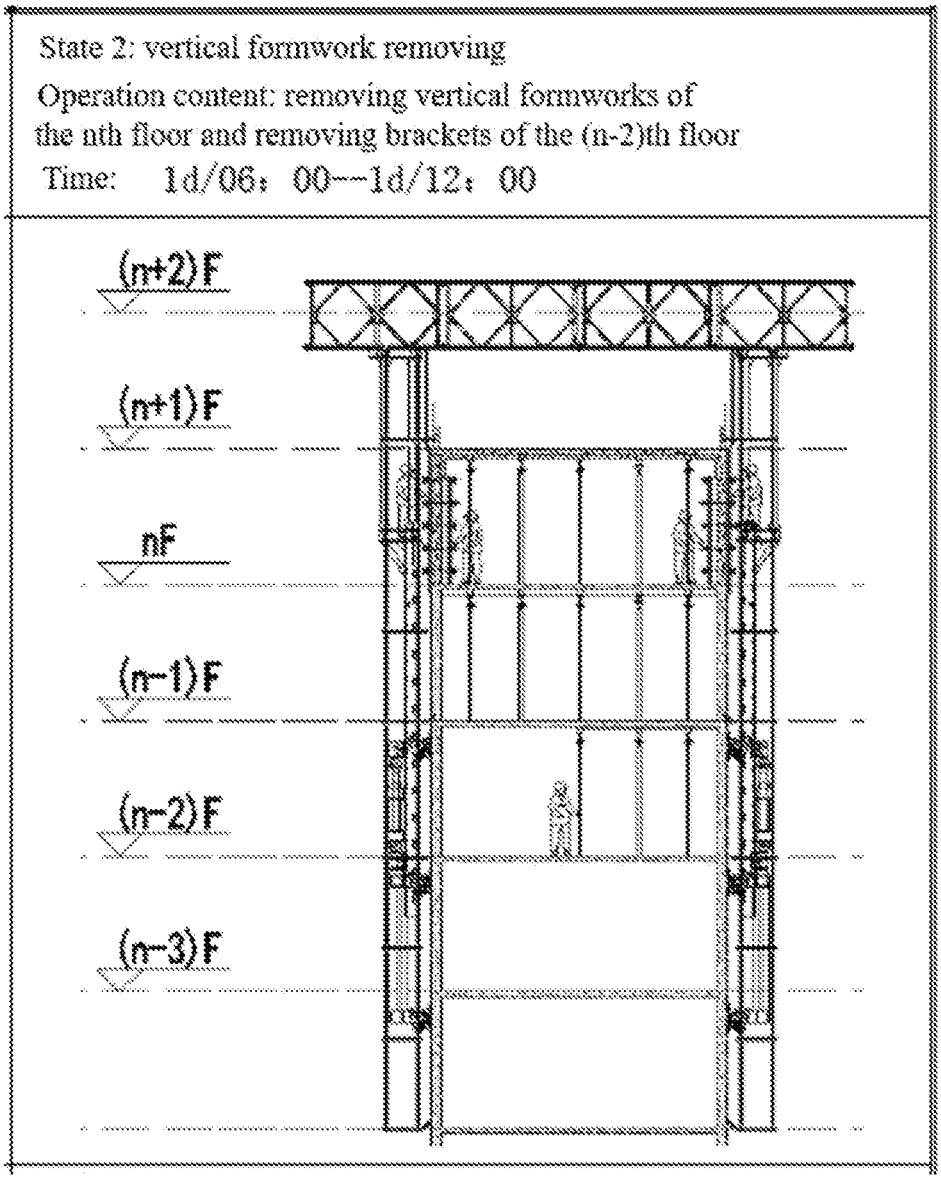
Figure 9C:
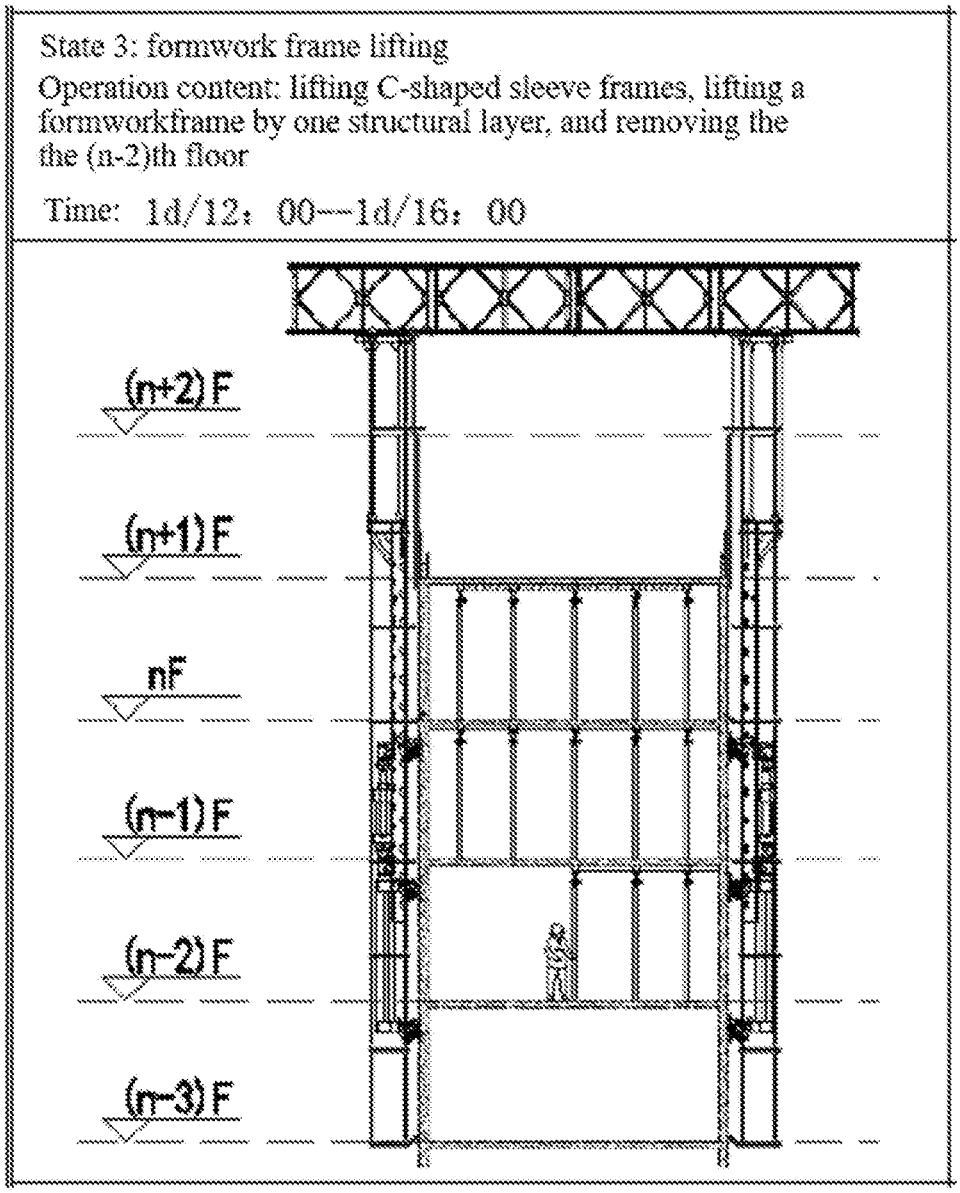
Figure 9D:
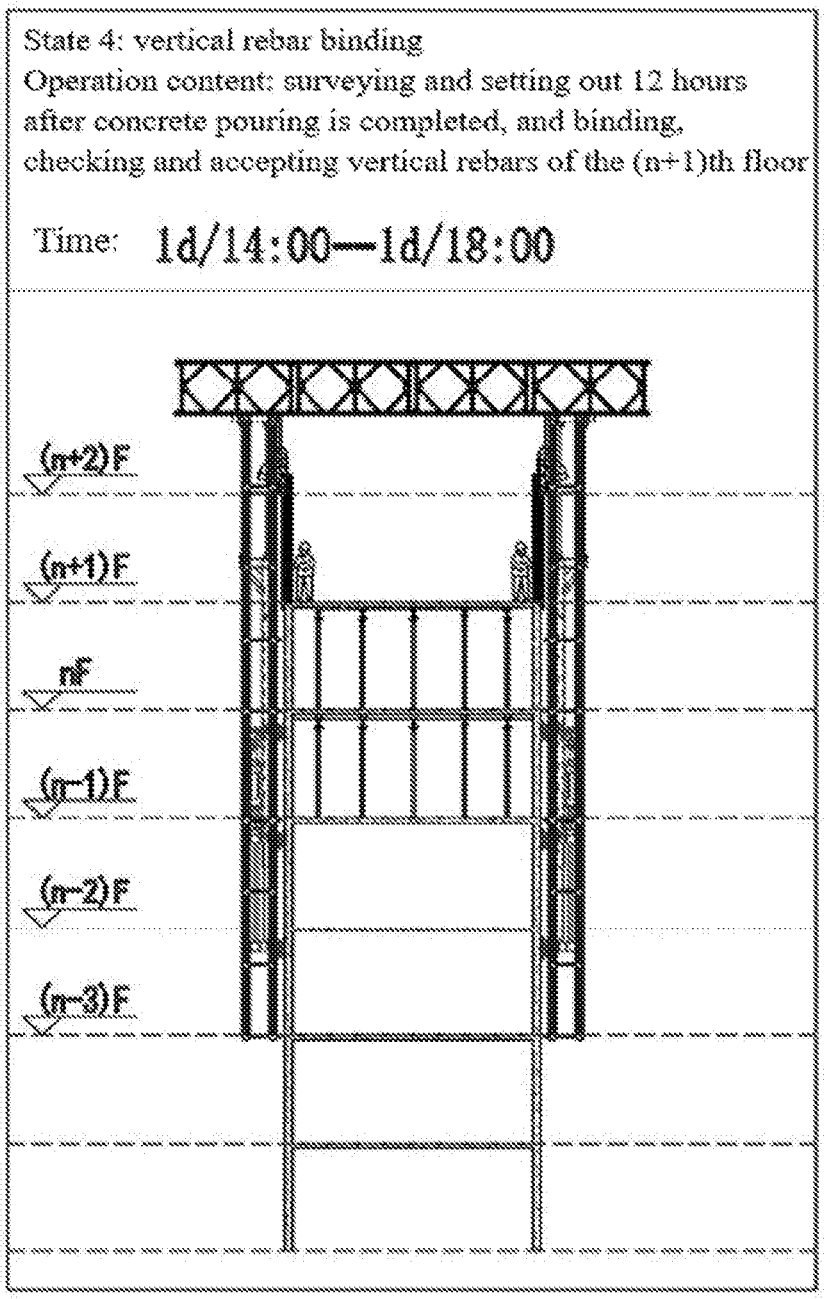
Figure 9E:
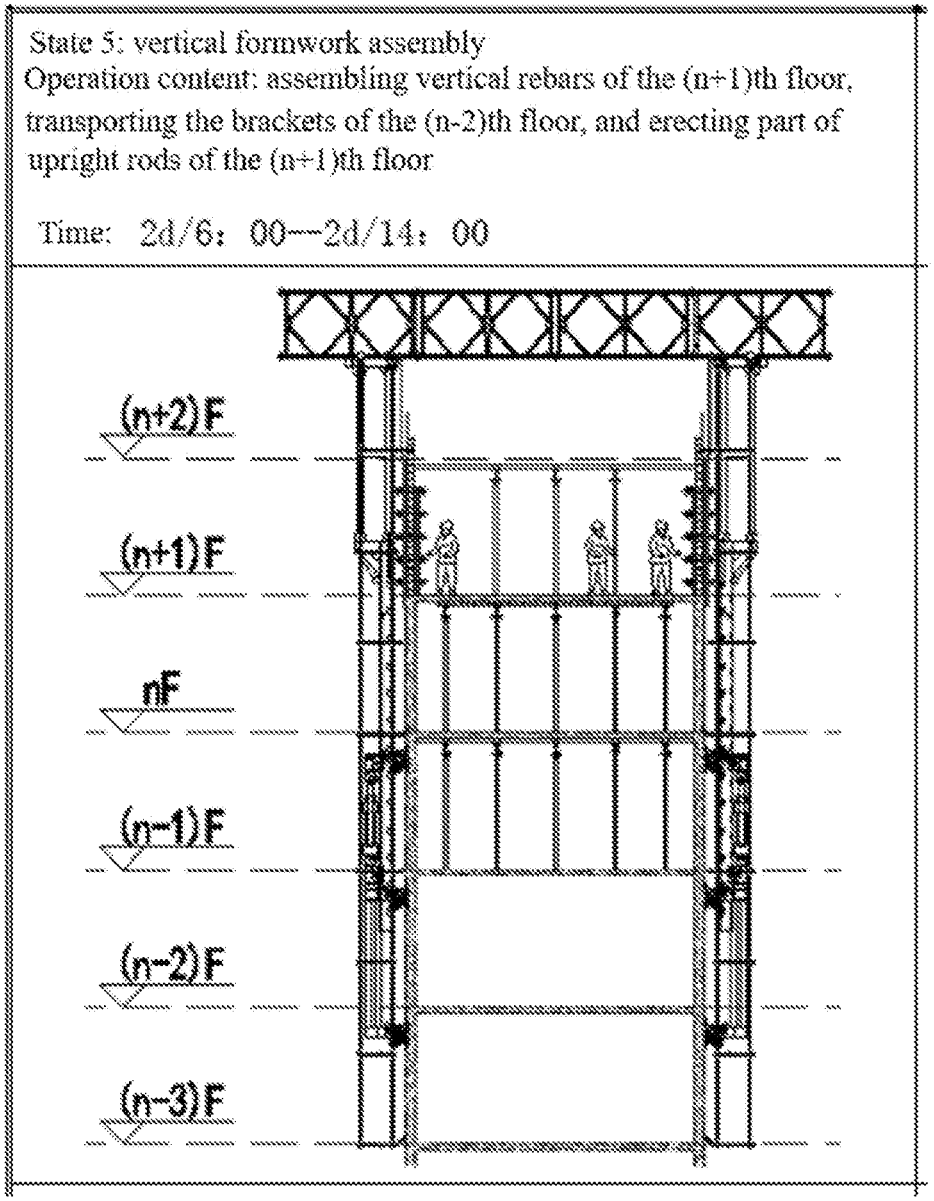
Figure 9F:
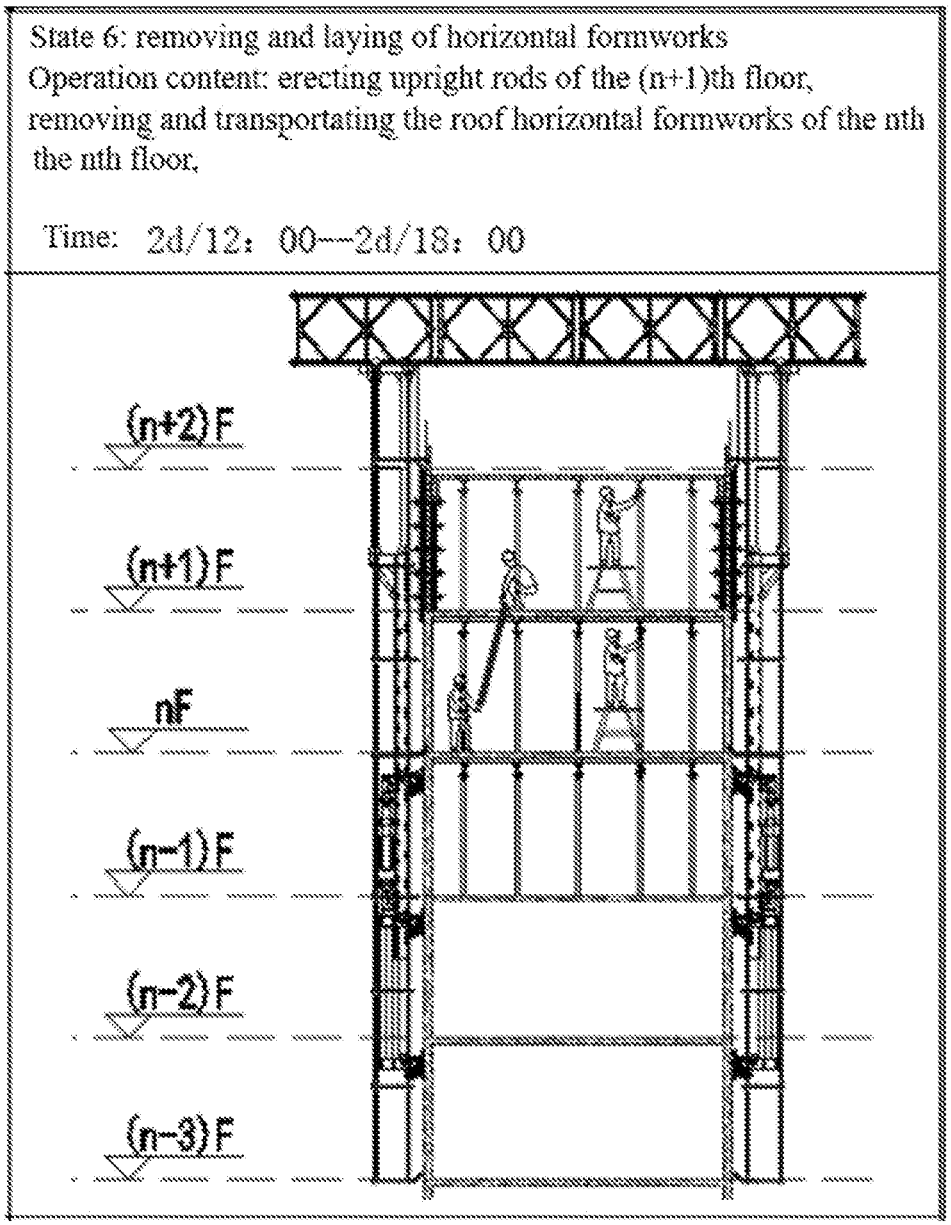
Figure 9G:
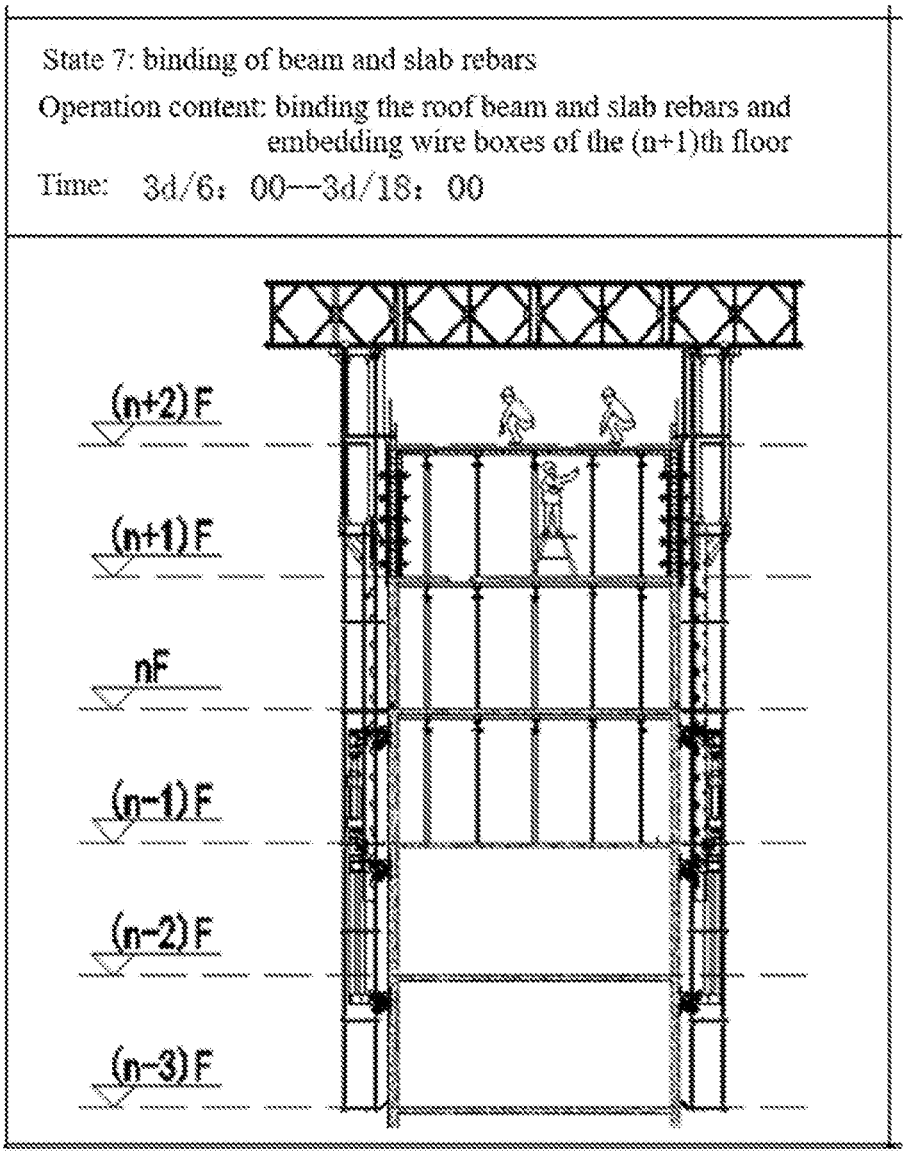
Figure 9H:
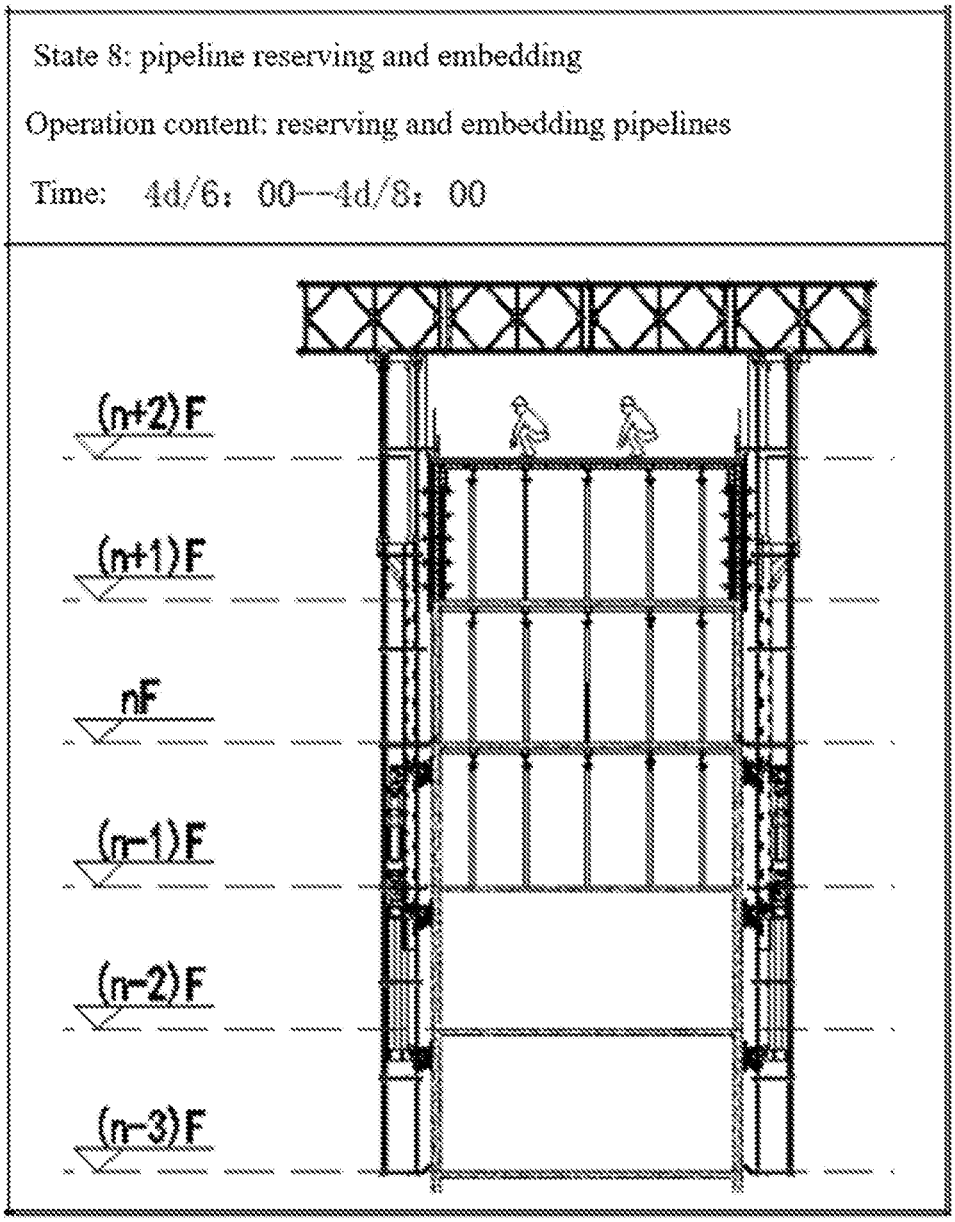
Figure 9I:
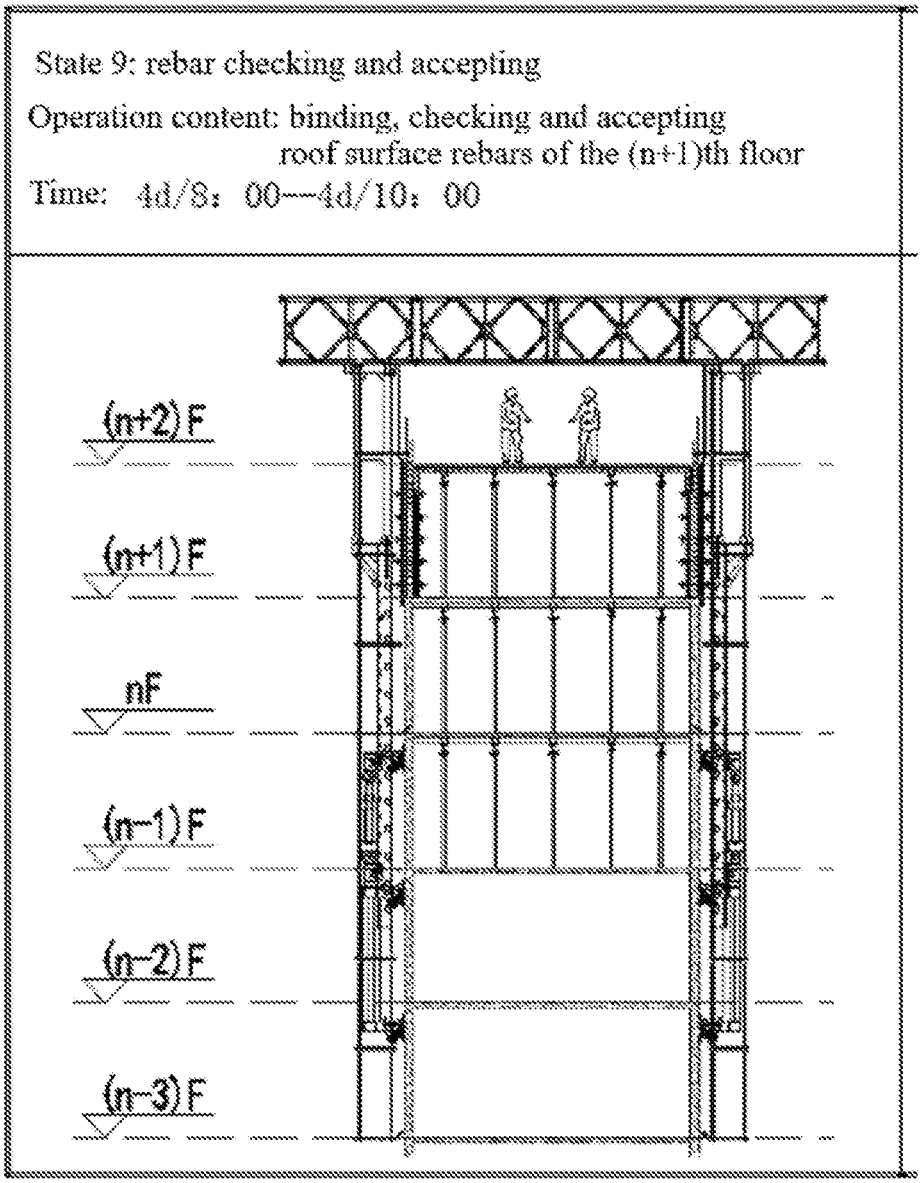
Figure 9J:
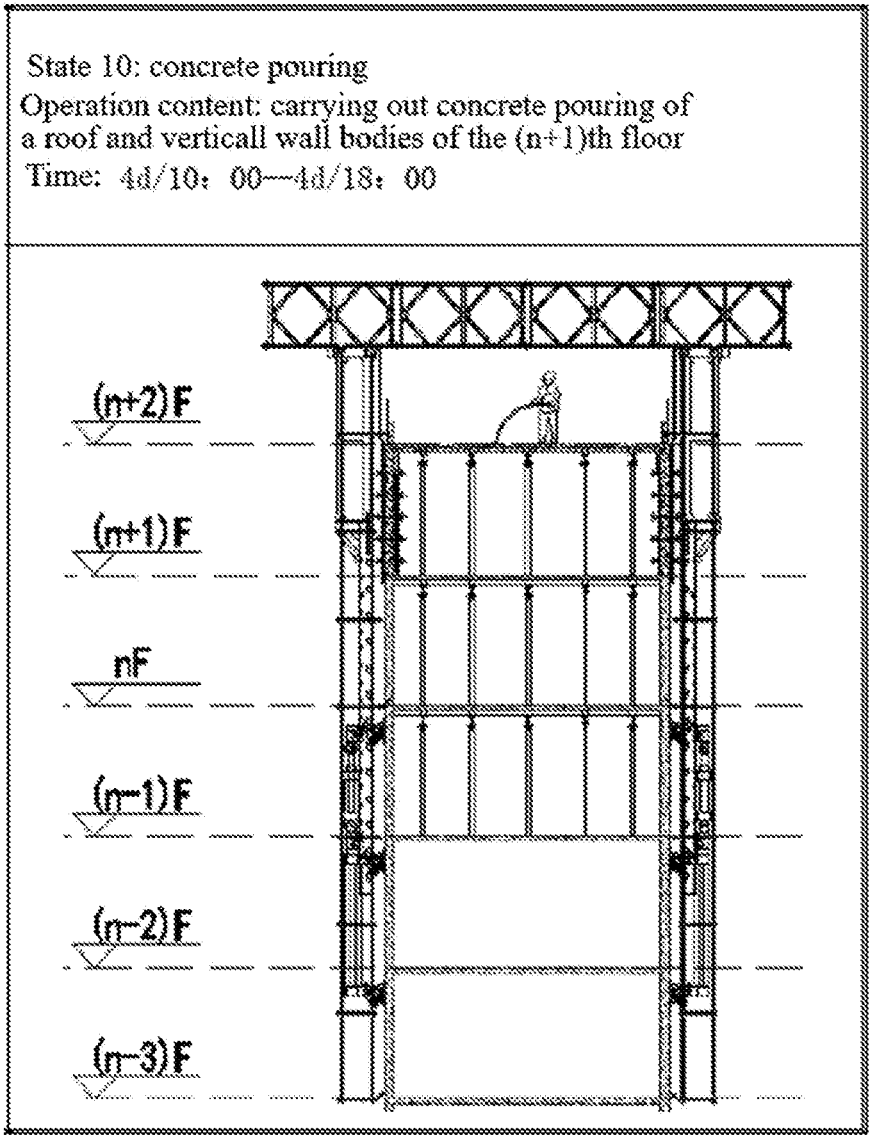

The implementation process is shown in FIG. 9*a* to FIG. 9*j*. In the present invention, by setting low-position wall-attached fulcrums below the operating floor, the periphery and the top of an operating surface are protected like a "steel cover", and construction auxiliary equipment and the frame body are integrated with the operating surface to achieve the greatest assistance effect on on-site services. The standard construction process is 4 days/floor with reference to the flowcharts for details, while the following only describes the key operating procedures of building equipment operations.

Step 1, concrete pouring of a roof and vertical wall bodies of an $n^{th}$ floor is completed to an initial state.

Step 2, through-wall screws are removed and vertical formworks 8 of the $n^{th}$ floor and brackets of an $(n-2)^{th}$ floor are removed after the formworks 8 of the vertical wall bodies of the $n^{th}$ floor reach removing conditions, wherein the overhanging formworks 8 on the outer side of an external wall and on an elevator shaft are separated from a structural wall body.

Step 3, horizontal protective flaps of a hanger system are turned up, and after checking the separation condition of hangers 7 and a formwork system from a structure, hydraulic devices are controlled through a control cabinet on the top surface of a top platform 6 to lift sleeve frames 2 by one floor at first and to lift track columns 4 and a whole building machine by one structural layer after the sleeve frames 2 are in place.

Step 4, after carrying out measuring and laying out on an $(n+1)^{th}$ floor structure, vertical rebars of the $(n+1)^{th}$ floor are bound, single-sided binding is adopted for areas with the formworks 8, and the vertical rebars are checked and accepted after binding is completed.

Step 5, the vertical formworks 8 of the wall bodies are erected, the vertical rebars of the $(n+1)^{th}$ floor are assembled, and the formworks 8 are pushed towards the wall body and clamped to the wall body in areas where the formworks 8 are suspended.

Step 6, the horizontal formworks 8 of the $(n+1)^{th}$ floor are erected.

Step 7, roof beam and slab rebars of the $(n+1)^{th}$ floor are bound and wire boxes of the $(n+1)^{th}$ floor are embedded.

Step 8, installation pipelines in the roof beams of the $(n+1)^{th}$ floor are reserved and embedded.

Step 9, rebars on a roof surface of the $(n+1)^{th}$ floor are bound, checked and accepted.

Step 10, concrete pouring of a roof and vertical wall bodies of the $(n+1)^{th}$ floor is carried out, and concrete pouring of the vertical wall bodies and the roof is completed at one step.

Step 11, operations return to step 1, the initial state is started and the construction operations are repeatedly carried out.

The embodiments of the present invention are described above with reference to the accompanying drawings, but the present invention is not limited to the above-mentioned specific embodiments. The above-mentioned specific embodiments are only illustrative and not restrictive. Under the enlightenment of the present invention, those of ordinary skill in the art can make many forms without departing from the purposes of the present invention and the protection scope of the claims, and these forms are all within the protection of the present invention.

What is claimed is:

1. A construction building equipment, comprising hanging pedestals, sleeve frames, hydraulic cylinders, upper reversing boxes, lower reversing boxes and track columns, wherein the multiple hanging pedestals are fixed on an outer side of a shear wall of an external wall, the sleeve frames and the track columns are clamped on the hanging pedestals, the sleeve frames are clamped on outer sides of the track columns, the lower reversing boxes are fixed at upper ends of the sleeve frames, the hydraulic cylinders are connected to the upper reversing boxes and the lower reversing boxes, side surfaces of the track columns are provided with pane holes for cooperative climbing of the upper reversing boxes and the lower reversing boxes, upper ends of the track columns are fixedly connected with a top platform, and hangers and formworks are suspended on the top platform through booms;

the hanging pedestals are provided with connecting bases, the top portions and the bottom portions of the sleeve frames are provided with lug plates used for cooperative fixing with the connecting bases, the lug plates are provided with short shafts, the short shafts are clamped in grooves of the connecting bases, the lug plates are rotatably disposed on the sleeve frames through rotating shafts, and the lug plates are further connected with the sleeve frames through tension springs; and guide bases are further disposed below the connecting bases, first guide wheels and second guide wheels are disposed on the guide bases, the first guide wheels are in contact with the sleeve frames, and the second guide wheels are in contact with the track columns.

2. The construction building equipment according to claim 1, wherein the hanging pedestals are provided with rotatable central hooks, the track columns are provided with multiple stoppers which are matched with the central hooks, and the central hooks are clamped under the stoppers to prevent the track columns from falling; and when the track columns are lifted, the stoppers located above the central hooks are separated from the central hooks, when the stoppers located under the central hooks move upwards to be in contact with the central hooks, the central hooks rotate under an acting force of the stoppers, and when the stoppers move upwards to positions above the central hooks, the central hooks return to initial positions, and the central hooks block the stoppers thereabove.

3. The construction building equipment according to claim 1, wherein the top platform is provided with hoisting equipment.

4. The construction building equipment according to claim 1, wherein a material distributor is disposed on the top platform.

5. A construction method adopting the construction building equipment according to claim 1, the construction method comprising the steps:

separating formworks from a wall body before an integrated platform is lifted, wherein the formworks include vertical formworks and horizontal formworks;

carrying the formworks through hydraulic cylinders to go up for one floor height;

binding vertical rebars of an upper floor;

assembling the vertical formworks after the vertical rebars of the upper floor are bound;

erecting the horizontal formworks; and pouring concrete to complete construction of one floor.

* * * * *